US006038992A

United States Patent [19]

Smith

[11] Patent Number: 6,038,992

[45] Date of Patent: Mar. 21, 2000

[54] BILGE OUTLET HULL FITTING FOR WATER CRAFT

[75] Inventor: Glenn S. Smith, South Lake Tahoe, Calif.

[73] Assignee: Glenn Smith, S. Lake Tahoe, Calif.

[21] Appl. No.: 09/352,185

[22] Filed: Jul. 12, 1999

[51] Int. Cl.[7] ..... B63B 13/00

[52] U.S. Cl. ..... 114/183 R

[58] Field of Search ..... 114/183 R; 440/89, 440/88

[56] References Cited

U.S. PATENT DOCUMENTS

| | | | |
|---|---|---|---|
| 4,875,884 | 10/1989 | Meisenburg | 440/88 |
| 4,986,777 | 1/1991 | Preston | 440/88 |
| 5,813,888 | 9/1998 | Ozawa | 440/89 |

OTHER PUBLICATIONS

West Marine, 1999 Power Master Catalog, "Thru Hull Fittings" and Thru Hulls and Seals, Cover page plus pp. 360–361 and back page.

*Primary Examiner*—Ed Swinehart
*Attorney, Agent, or Firm*—Sierra Patent Group, Ltd.

[57] ABSTRACT

A through-hull fitting for use on water-craft that allows for contained environment discharge of bilge material. The through hull fitting is a hollow tube, outwardly threaded and ribbed at the inner-hull end, and inwardly threaded at the outer hull end. A threaded lock nut is used to secure the inner-hull end against the inner hull, and the mushroom head of the outer end secures the fitting against the outer hull. The inwardly threaded portion of the fitting allows for an oppositely threaded coupling, such as that found on the male end of a standard garden hose.

4 Claims, 3 Drawing Sheets

BILGE OUTLET HULL FITTING FOR WATER CRAFT

BACKGROUND OF THE INVENTION

1. Field of the Invention

The present invention relates generally to boats and more particularly to fittings which allow the discharge of bilge water from the bilge through the hull of a boat. More particularly, the present invention relates to mushroom-head-through-hull fittings which are oppositely mateable to allow connections to a hose, such as a standard garden hose and other connectors to connect directly to the fitting on the outside of the hull in order to pump bilge water into a container or other controlled environment.

2. The Prior Art.

The use of mushroom-head-through-hull fittings to allow the discharge of bilge water through hulls of watercraft is standard equipment on most watercraft. However, the present state of the art fittings discharge bilge water directly into the waterway or the ground if the boat is in dry dock or transport. As a result, contaminates in the bilge, such as oil, gasoline, diesel fuel, antifreeze and cleaning compounds are discharged overboard creating environmental pollution. Additionally, the discharge of these contaminates is often illegal and large fines may be imposed for violations. Numerous head-through-hull type fittings are known in the prior art, such as those available from West Marine of Watsonville, Calif. None of the offered fittings allow for anything other than an into the environment discharge.

None of the aforementioned related art devices provide a head through hull fitting which can receive the end of a fitting such as a standard garden hose, etc. Consequently, a need exists for an improved through hull fitting which would allow a common variety garden hose, larger hose or other type of tubing to be connected directly to the through-hull fitting so that toxic bilge effluent can be contained.

SUMMARY OF THE INVENTION

The offered fitting of the present invention solves the problems identified above. The head through hull assembly of the present invention is essentially a hollow tube having an in-boat bilge connection to facilitate a bilge connection, an in-hull threaded nut to tighten against the inner hull of any water craft. The inner hull end of the through hull fitting has external circumferential ribs molded or machined therein to promote friction and a hose clamp to secure a bilge connection tube to it. The outer hull mushroom head fits flush against an outer hull of a vessel and has a mating fitting, such as inner threads, to receive any variety of a corresponding mating fitting, such as a threaded coupling, the exemplary embodiment being standard garden hose fittings.

The present invention allows toxic and contaminated bilge water to be pumped to an enclosed and controllable environment such as a holding, tank for transport or treatment. In the preferred embodiment, the head through hull fitting is composed of two pieces: the fitting body and an in-hull lock nut.

In its primary aspect, the present invention provides a boat owner with the means to connect, for example, a standard garden hose or other fitting to the bilge outlet. The invention can feature low production costs by the use of plastic which provides durability and light weight, or if sturdiness is desired brass or other types of metal and materials such as bronze and marelon may be used for production. The size of the through-hull fitting will vary depending on the flow of the bilge pump, the discharge hose and the discharge orifice of the through-hull fitting. The invention can be applied to through-hull fittings of all sizes that are machined or molded. The low cost of plastic production provides an economical retrofit of existing watercraft in areas where environmental bilge discharge regulations are in effect.

Further objects and advantages of the invention will become apparent from a consideration of the drawings and the ensuing description.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Those of ordinary skill in the art will realize that the following description of the present invention is illustrative only and not in any way limiting. Other embodiments of the invention will readily suggest themselves to such skilled persons.

Figure 1:
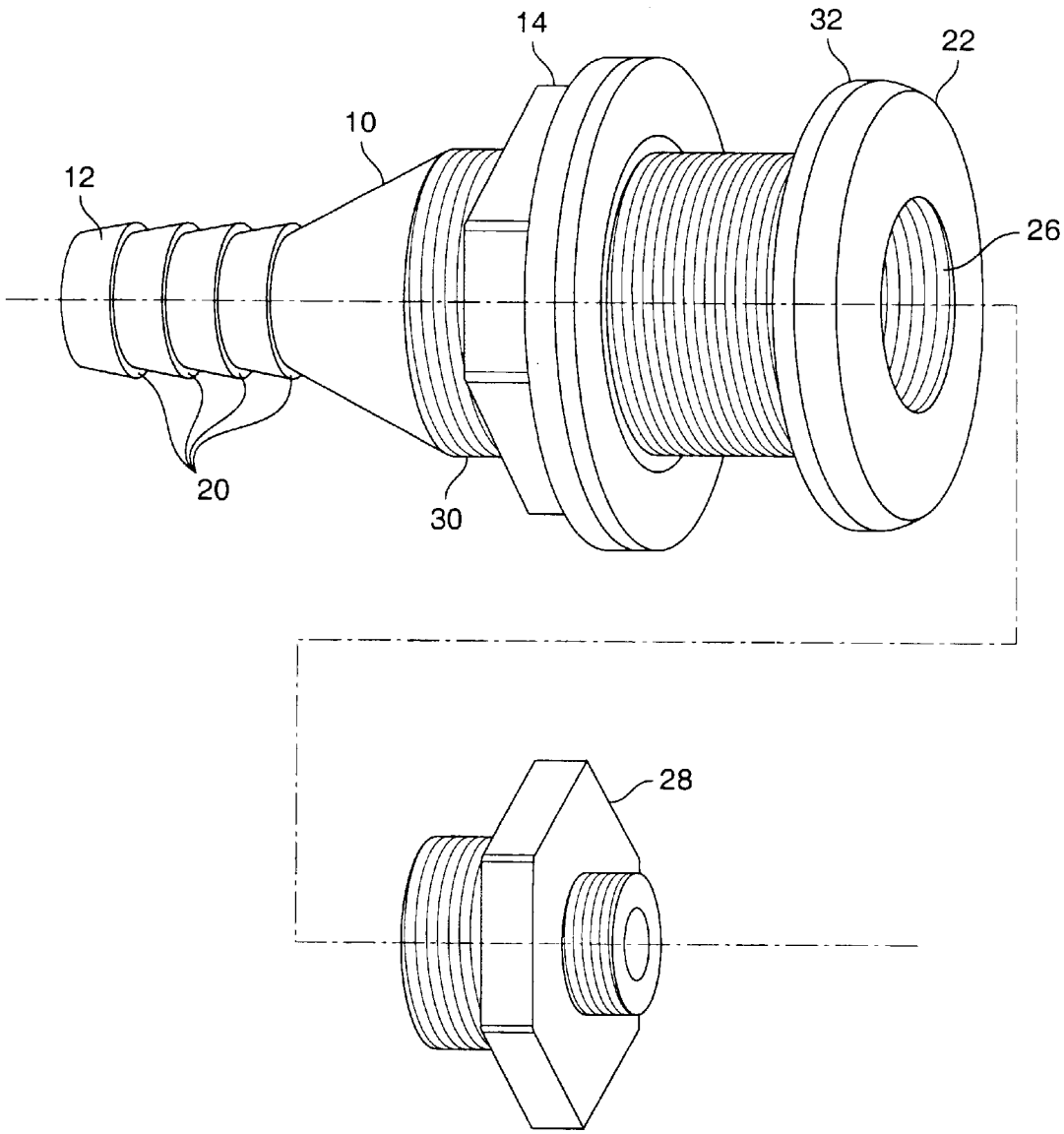
FIG. 1 is an illustration of the head through hull fitting of the present invention also showing a standard size fitting which can be accommodated by the head through hull fitting.
Figure 2:
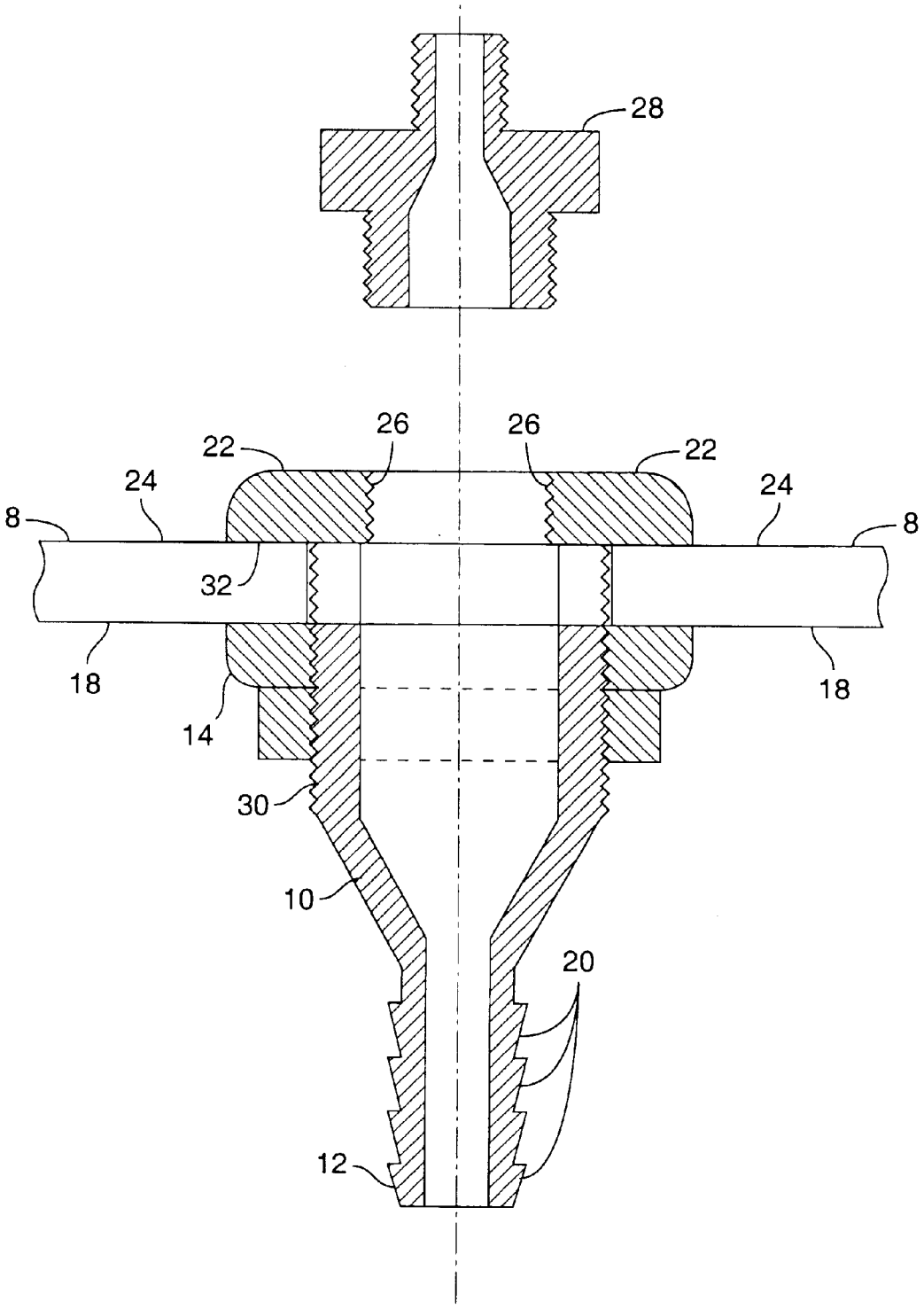
FIG. 2 is a cross section of the fitting assembly of the present invention shown in a typical in-hull installation.
Figure 3:
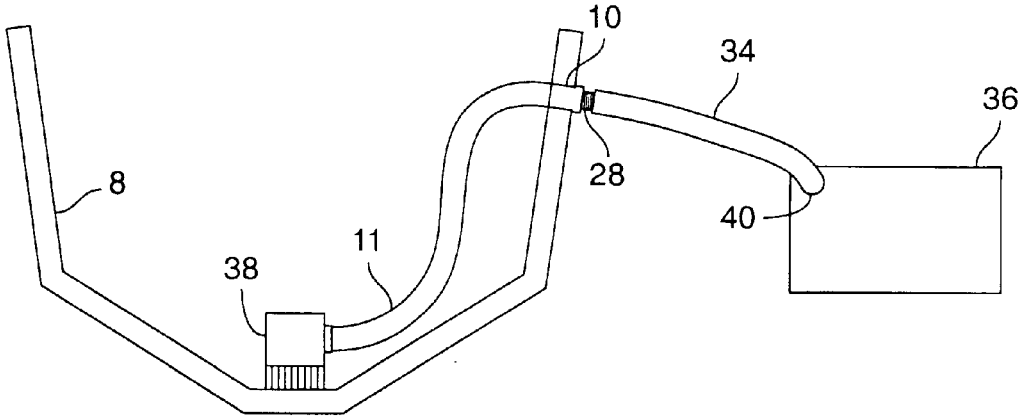
FIG. 3 shows a typical installation of the invention in the hull of a watercraft.
Figure 4:
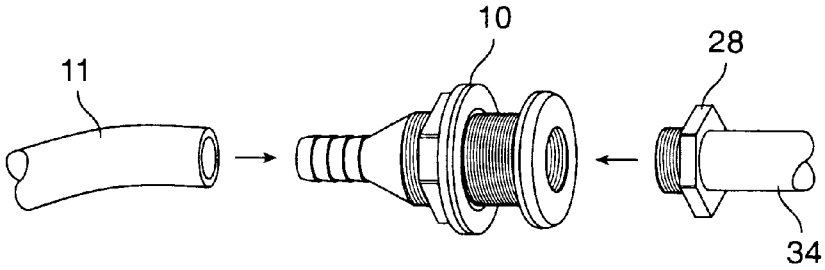
FIG. 4 shows how the through hull fitting is installed and how it would accomodate a standard sized garden hose.

With reference to the figures where like elements have been given like numerical designations to facilitate the reader's understanding of the present invention, and particularly with reference to the embodiments of the present invention illustrated in FIGS. 1, 2, 3, and 4. FIG. 1 shows an exemplary device and FIGS. 2, 3 and 4 show the exemplary device in a typical hull 8, installation. FIG. 1 shows the head through hull assembly, which is essentially a hollow tube is designated generally as 10, and which has an in-boat bilge connection 12, and an in-hull threaded lock nut 14. The inner hull end of the through hull fitting has ribs 20, molded or machined into the device, to promote friction with and thereby secure a bilge connection tube 11 to it, when used with a hose clamp. There is an outer hull mushroom head 22, which has inner threads 26 to receive any variety of an oppositely threaded coupling 28; the exemplary embodiment being standard garden hose fittings. The outer portion of the cylinder also has threads, 30.

In an installation of the preferred embodiment, shown in FIG. 2, the main body of the through-hull-fitting 12, is inserted through an appropriately sized opening in the hull of the watercraft, 8 from the outer-hull side until the inner portion of the mushroom head 32, is flush against the outer hull 24. Then, from the inner hull side, the inner hull lock nut 14, is placed flush against the inner hull, which is tightened to the appropriate torque. Finally, a receiving hose 34 with the appropriately sized male fitting 28, is threadingly fitted into the outer hull receiving threads, 26 and contained environment bilge pumping is free to commence. Fitting body 10 can be made of many types of materials. In the preferred embodiment, fitting body 12, and its hardware, 14 are made of plastic, however, other materials such as brass and other metals or other synthetic materials may be used.

Viewed from a first vantage point, a method for discharging bilge water from water craft is disclosed, comprising, providing a through hull fitting 10, in a hull of the watercraft 8, providing a bore through the hull, coupling an output of a bilge pump 38, to a first end of said bore disposed inside said hull, coupling a first end of a hose 28, to a second end of said bore disposed outside of said hull and a second end of a hose 40, to an enclosed volume 36, and running the bilge pump 38.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A method for discharging bilge water from water craft comprising:

providing a through hull of a watercraft, said fitting providing a bore through said hull;

coupling an output of a bilge pump to a first end of said bore disposed inside said hull;

coupling a first end of a hose to a second end of said bore disposed outside of said hull and a second end of a hose to an enclosed volume; and running said bilge pump.

2. A method for discharging bilge water from water craft comprising:

providing a through hull fitting in a hull of a watercraft, said fitting having a first end and a second end and providing a bore through said hull;

coupling an output of a bilge pump to said first end of said bore disposed inside of said hull;

coupling a first end of a hose to a said second end of said bore disposed outside of said hull and a second end of a hose to an enclosed volume; and running said bilge pump.

3. A method for discharging bilge water from water craft according to claim 2, wherein providing a through hull fitting comprises providing one with a threaded portion on said second end.

4. A method for discharging bilge water from water craft according to claim 3 wherein said threaded portion is adapted to mate with a standard garden hose.

* * * * *